US010909924B2

(12) United States Patent
Yang et al.

(10) Patent No.: US 10,909,924 B2
(45) Date of Patent: Feb. 2, 2021

(54) PIXEL CIRCUIT AND DRIVING METHOD THEREOF, AND DISPLAY PANEL

(71) Applicant: BOE TECHNOLOGY GROUP CO., LTD., Beijing (CN)

(72) Inventors: Shengji Yang, Beijing (CN); Xue Dong, Beijing (CN); Jing Lv, Beijing (CN); Xiaochuan Chen, Beijing (CN); Can Zhang, Beijing (CN); Wei Sun, Beijing (CN); Lingyun Shi, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 368 days.

(21) Appl. No.: 15/761,336

(22) PCT Filed: Sep. 7, 2017

(86) PCT No.: PCT/CN2017/100888
§ 371 (c)(1),
(2) Date: Mar. 19, 2018

(87) PCT Pub. No.: WO2018/126725
PCT Pub. Date: Jul. 12, 2018

(65) Prior Publication Data

US 2020/0243003 A1 Jul. 30, 2020

(30) Foreign Application Priority Data

Jan. 3, 2017 (CN) ..... 2017 1 0001414

(51) Int. Cl.
*G09G 3/325* (2016.01)
*G09G 3/3258* (2016.01)
*G09G 3/3283* (2016.01)

(52) U.S. Cl.
CPC ..... *G09G 3/325* (2013.01); *G09G 3/3258* (2013.01); *G09G 3/3283* (2013.01); *G09G 2320/045* (2013.01)

(58) Field of Classification Search
CPC .... G09G 3/3233; G09G 3/3241; G09G 3/325; G09G 3/3258; G09G 3/3283;
(Continued)

(56) References Cited

U.S. PATENT DOCUMENTS 8,441,417 B2 * 5/2013 Uchino ..... G02B 6/4214 345/76
9,773,451 B2 * 9/2017 Wu ..... G09G 3/3258
(Continued)

FOREIGN PATENT DOCUMENTS

CN 1460982 A 12/2003
CN 1744182 A 3/2006
(Continued)

OTHER PUBLICATIONS

International Search Report of PCT/CN2017/100888 in Chinese, dated Nov. 30, 2017 with English translation.
(Continued)

*Primary Examiner* — Tom V Sheng
(74) *Attorney, Agent, or Firm* — Collard & Roe, P.C.

(57) ABSTRACT

This application provides a pixel circuit and a driving method thereof, and a display panel. The pixel circuit includes: an input unit, a driving unit and a voltage compensation unit, wherein the input unit is connected to a data line and a first scan line, and configured to input a hopping data signal inputted at the data line to the voltage compensation unit under control of the first scan line; the voltage compensation unit is connected to a first node, a second scan line and a third scan line, and configured to generate a compensation voltage at the first node under control of the
(Continued)

second scan line and the third scan line; the driving unit is connected to the voltage compensating unit, and configured to generate a current for driving a light emitting device to emit light using the compensation voltage generated by the voltage compensating unit at the first node. In the pixel circuit and the driving method thereof and the display panel according to the present disclosure, threshold voltage compensation performed on the driving transistor of the pixel circuit and smart displaying are combined, and resolution of the display panel can be adjusted in real time with respect to that the user has different attentions on the picture displayed by the display panel.

15 Claims, 10 Drawing Sheets

(58) Field of Classification Search
CPC ..... G09G 2300/043; G09G 2300/0819; G09G 2310/0262; G09G 2310/0251; G09G 2320/043; G09G 2320/045
See application file for complete search history.

(56) References Cited

U.S. PATENT DOCUMENTS

2003/0214476 A1 11/2003 Matsuda et al.
2006/0044230 A1 3/2006 Eom
2008/0198104 A1* 8/2008 Yamashita ..... G09G 3/3258 345/77
2008/0224965 A1 9/2008 Kim
2009/0309816 A1* 12/2009 Choi ..... G09G 3/3233 345/76
2010/0026729 A1* 2/2010 Toyomura ..... G09G 3/3233 345/690
2010/0118002 A1* 5/2010 Yamashita ..... G09G 3/3233 345/205
2010/0321422 A1* 12/2010 Ishiguro ..... G09G 3/3233 345/698
2012/0146891 A1 6/2012 Kalinli
2012/0146979 A1* 6/2012 Kim ..... G09G 3/3233 345/211
2013/0106828 A1* 5/2013 Kim ..... G09G 3/3233 345/212
2013/0335307 A1 12/2013 Guo et al.
2013/0335456 A1* 12/2013 Matsui ..... G09G 3/30 345/690
2014/0022150 A1 1/2014 Guo et al.
2014/0055578 A1 2/2014 Wu et al.
2014/0333686 A1* 11/2014 Kim ..... G09G 3/3233 345/694
2015/0356919 A1 12/2015 Wang et al.
2016/0253958 A1 9/2016 Ma
2016/0267841 A1 9/2016 Yang
2016/0267843 A1 9/2016 Wang et al.
2016/0275854 A1* 9/2016 Wang ..... G09G 3/3233
2016/0275861 A1 9/2016 Yang et al.
2016/0351122 A1* 12/2016 Jung ..... G09G 3/2085
2016/0351124 A1* 12/2016 Kim ..... G09G 3/3241
2016/0366365 A1 12/2016 Iyer et al.
2017/0153759 A1 6/2017 Ding et al.
2017/0249904 A1* 8/2017 Li ..... G09G 3/3233
2018/0012548 A1* 1/2018 Koh ..... G09G 3/3258
2018/0182287 A1* 6/2018 Park ..... G09G 3/3233
2019/0347988 A1* 11/2019 Zhang ..... G09G 3/32
2020/0043417 A1* 2/2020 Yang ..... G09G 3/3291

FOREIGN PATENT DOCUMENTS

CN 101266757 A 9/2008
CN 102842301 A 12/2012
CN 103000132 A 3/2013
CN 103035202 A 4/2013
CN 103249352 A 8/2013
CN 104036725 A 9/2014
CN 104036729 A 9/2014
CN 104050916 A 9/2014
CN 104078005 A 10/2014
CN 104752468 A 7/2015
CN 104835454 A 8/2015
CN 105206221 A 12/2015
CN 106254952 A 12/2016

OTHER PUBLICATIONS

Notice of Transmittal of the International Search Report of PCT/CN2017/100888 in Chinese, dated Nov. 30, 2017.
Written Opinion of the International Searching Authority of PCT/CN2017/100888 in Chinese, dated Nov. 30, 2017 with English translation.
Chinese Office Action in Chinese Application No. 201710001414.X, dated Jan. 4, 2019 with English translation.

* cited by examiner

PIXEL CIRCUIT AND DRIVING METHOD THEREOF, AND DISPLAY PANEL

CROSS-REFERENCE TO RELATED APPLICATIONS

This application is the National Stage of PCT/CN2017/100888 filed on Sep. 7, 2017, which claims priority under 35 U.S.C. § 119 of Chinese Application No. 201710001414.X filed on Jan. 3, 2017, the disclosure of which is incorporated by reference.

TECHNICAL FIELD

The present disclosure relates to the field of display technology, and more particularly, relates to a pixel circuit and a driving method thereof, and a display panel comprising the pixel circuit.

BACKGROUND

OLED (Organic Light-Emitting Diode) display is one of the hot spots in the current research field of flat panel display. Compared with LCD (liquid crystal display), OLED display has the advantages of low energy consumption, low manufacturing cost, self-luminescence, wide viewing angle, fast response speed and the like. At present, OLED display has begun to replace the traditional LCD in the display field of mobile phones, PDAs, digital cameras and the like. Pixel circuit design is the core technology content of the OLED display, and has important research significance. Unlike TFT (Thin Film Field Effect Transistor)-LCD which uses a steady voltage to control luminance of light emitting transistors, OLED is current-driven and requires a steady current to control luminance of light emitting diodes. The current passing through the OLED is not only controlled by the voltage of the data signal but also affected by the threshold voltage $V_{th}$ of the driving thin film transistor which drives the light emitting diodes. Due to reasons of different characteristics of the threshold voltages $V_{th}$ of the driving transistors in the plurality of pixel circuits, manufacturing process, device aging and the like, the driving TFTs at respective pixel dots in the OLED display do not have completely consistent performance parameters, and the threshold voltages $V_{th}$ of the driving TFTs Vth will drift, which results in different currents flowing through respective pixel dots of the OLED, thus the display effect of the OLED display is affected.

In addition, when an image is displayed by the existing display screen, resolutions of respective areas are the same, it is impossible to dynamically adjust the resolution of a local area on the display panel in real time according to visual attention of the user.

SUMMARY

In view of the above problems, the present disclosure provides a pixel circuit and a driving method thereof, and a display panel. The pixel circuit can perform threshold voltage compensation with respect to the driving transistor that drives the light emitting devices to emit light for displaying, which removes the influence caused by drifting of the threshold voltage on the driving current of the driving transistor, so as to prevent inconsistency of light emitting display of the light emitting devices caused by unevenness of the threshold voltages of the respective driving transistors.

According to an aspect of the present disclosure, there is provided a pixel circuit, comprising: an input sub-circuit, a driving sub-circuit and a voltage compensation sub-circuit, wherein the input sub-circuit is connected to a data line and a first scan line, and configured to input a hopping data signal inputted at the data line to the voltage compensation sub-circuit under control of the first scan line; the voltage compensation sub-circuit is connected to a first node, a second scan line and a third scan line, and configured to generate a compensation voltage at the first node under control of the second scan line and the third scan line; the driving sub-circuit is connected to the voltage compensating sub-circuit, and configured to generate a current for driving a light emitting device to emit light using the compensation voltage generated by the voltage compensating sub-circuit at the first node.

According to an aspect of the present disclosure, there is further provided a method of driving the pixel circuit, the method comprising: applying an effective level to the first scan line, writing a hopping data signal on the data line into the pixel circuit, and generating a compensation voltage at the first node.

According to the principle of the present disclosure, by means of writing the hopping data signal on the data line into the voltage compensation sub-circuit, the voltage compensation sub-circuit is made to generate a compensation voltage at the first node, threshold voltage compensation can be therefore performed on the driving transistor, which eliminates the influence on light emitting display of the light emitting devices caused by drifting of the threshold voltage of the driving transistor in the pixel circuit.

Optionally, the pixel circuit further comprises: a light emitting control sub-circuit connected to a plurality of light emitting devices, a plurality of light emitting control signal terminals and the driving sub-circuit, and configured to provide the driving current generated by the driving sub-circuit to the plurality of light emitting devices under control of light emitting control signals inputted at the plurality of light emitting control signal terminals.

Optionally, the method of driving the pixel circuit further comprises: in the case of displaying at a first resolution, changing the data signal on the data line, writing a different data signal on the data line into the pixel circuit, thereby causing the driving sub-circuit to generate a different driving current, sequentially applying an effective level to the plurality of light emitting control signal terminals, thus supplying different driving currents generated by the driving sub-circuit to the plurality of light emitting devices; in the case of displaying at a second resolution, simultaneously applying an effective level to the plurality of light emitting control signal terminals to provide the driving current generated by the driving sub-circuit to the plurality of light emitting devices, wherein the first resolution being higher than the second resolution.

According to the principle of the present disclosure, the resolution of the pixel area may be adjusted by controlling the data signal on the data line and controlling the effective level applied to the plurality of light emitting control signal terminals according to adjustment requirement of the display resolution, and luminescence of the plurality of light emitting devices may be combined to achieve different visual resolutions.

According to an aspect of the present disclosure, there is further provided a display panel, comprising: a plurality of pixel circuits described above arranged in an array.

Optionally, the display panel further comprises: at least one sensor configured to detect eye movement of a user viewing an interface of the display panel and generate an eye movement detection signal; and a processor configured to determine an area on the interface concerned by the user according to the eye movement detection signal, and change the data signal on the data line in the pixel circuit corresponding to the area, sequentially apply an effective level to the plurality of light emitting control signal terminals, thereby increase resolution in the area.

Optionally, the pixel array of the display panel may be zoned, area of the zonation may be determined according to specific viewing needs. With eye tracking technology, a position of an area on the screen which human eyes are interested in is determined, and the area of interest is displayed at a higher resolution, while other areas of non-interest are displayed at a lower resolution. Specifically, eye movement of the user may be detected by a sensor, and a specific area viewed by the user may be determined by the sensor, so as to achieve resolution differentiation of display areas. As the position where human eyes view changes, it is possible to switch among resolutions of areas at different positions, the effect of adjustable resolution is truly achieved. Thereby, resolutions of the respective display areas can be dynamically adjusted in real time, and the display power consumption is reduced.

According to the principle of the present disclosure, threshold voltage compensation performed on the driving transistor of the pixel circuit and smart displaying are combined, and resolution of the display panel can be adjusted in real time with respect to that users have different attentions on the picture displayed by the display panel, so that the area of interest to the user is displayed in a higher resolution, and the area of non-interest is displayed in a lower resolution, so that power consumption is reduced.

BRIEF DESCRIPTION OF THE DRAWINGS

In order to explain the technical solutions in the embodiments of the present disclosure more clearly, the accompanying drawings in the embodiments are briefly introduced below. Apparently, the accompanying drawings in the following description only relate to some embodiments of the present disclosure, and are not intended to limit the present disclosure.

DETAILED DESCRIPTION OF THE EMBODIMENTS

Hereinafter, the embodiments of the present disclosure will be described clearly and comprehensively in connection with the accompanying drawings. Obviously, these described embodiments are merely parts of the embodiments of the present disclosure, rather than all of the embodiments thereof. Other embodiments obtained by a person of ordinary skill in the art based on the embodiments of the present disclosure without paying creative effort all fall into the protection scope of the present disclosure.

Figure 1:
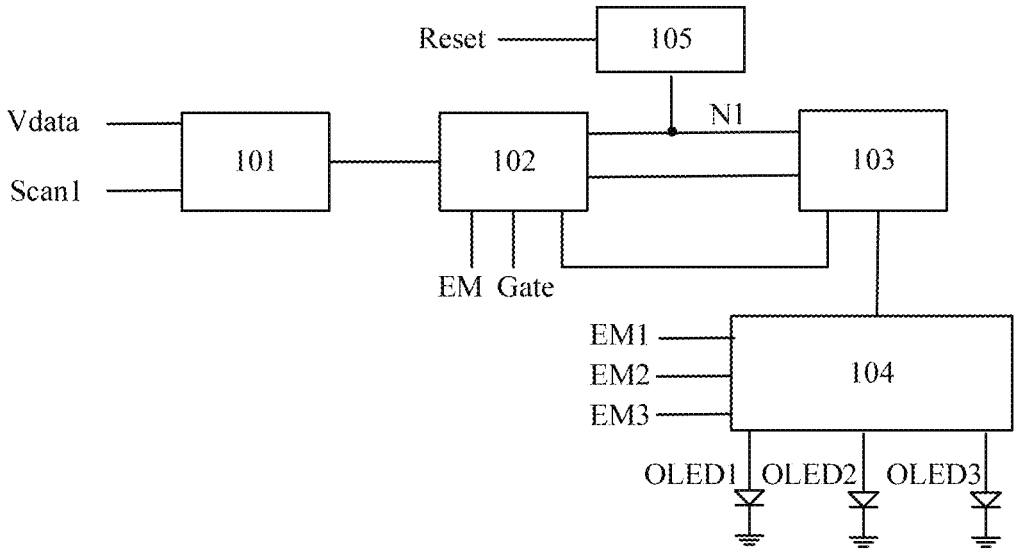
FIG. 1 is a block diagram of a pixel circuit according to an embodiment of the present disclosure.

FIG. 1 is a schematic block diagram of a pixel circuit according to an embodiment of the present disclosure. As shown in FIG. 1, the pixel circuit comprises: an input sub-circuit 101, a driving sub-circuit 102 and a voltage compensation sub-circuit 103. The input sub-circuit 101 is connected to a data line Vdata and a first scan line Scan1, and configured to input a hopping data signal inputted at the data line Vdata to the voltage compensation sub-circuit 103 under control of the first scan line Scan1. The voltage compensation sub-circuit 103 is connected to a first node N1, a second scan line Gate and a third scan line EM, and configured to generate a compensation voltage at the first node N1 under control of the second scan line Gate and the third scan line EM. The driving sub-circuit 102 is connected to the voltage compensating sub-circuit 103, and configured to generate a current for driving a light emitting device to emit light using the compensation voltage generated by the voltage compensating sub-circuit 103 at the first node N1.

Optionally, the pixel circuit further comprises: a light emitting control sub-circuit 104 connected to a plurality of light emitting devices OLED1, OLED2, OLED3, a plurality of light emitting control signal terminals EM1, EM2, EM3 and the driving sub-circuit 102, and configured to provide the driving current generated by the driving sub-circuit 102 to the plurality of light emitting devices OLED1, OLED2, OLED3 under control of light emitting control signals inputted at the plurality of light emitting control signal terminals EM1, EM2, EM3. As will be appreciated, the three light emitting devices OLED are only exemplary, a person skilled in the art can adjust the number of the light emitting devices according to actual needs.

Optionally, the pixel circuit further comprises: a reset sub-circuit 105 connected to a reset signal terminal Reset and the first node N1, and configured to reset the first node N1 under control of a reset signal inputted at the reset signal terminal Reset.

The pixel circuit according to the present disclosure may use the voltage compensation sub-circuit 103 to generate a compensation voltage at the first node N1, therefore perform threshold voltage compensation on the driving transistor M3, which eliminates the influence on light emitting display of the light emitting devices OLED caused by drifting of the threshold voltage of the driving transistor M3 in the pixel circuit.

In addition, the pixel circuit according to the present disclosure may, by means of controlling the data signal on the data line Vdata and controlling the effective level applied to the plurality of light emitting control signal terminals EM1, EM2, EM3, adjust the resolution of the pixel area according to adjustment requirement of the display resolution, and combine luminescence of the plurality of light emitting devices OLED to achieve different visual resolutions.

Figure 2:
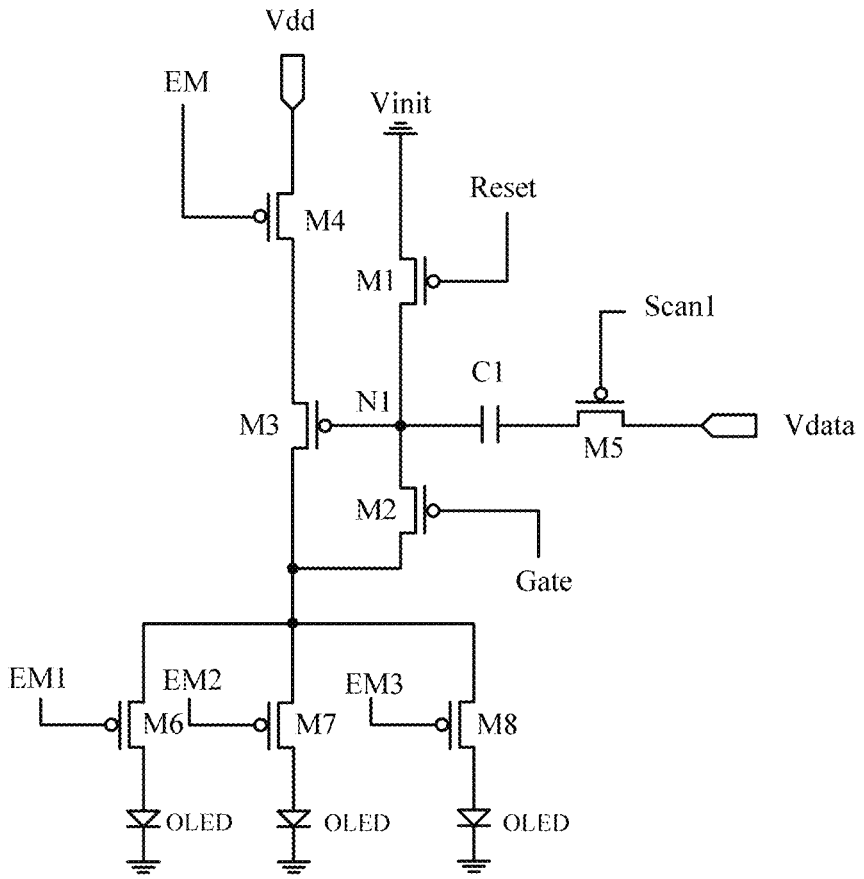
FIG. 2 shows a circuit structure of a pixel circuit according to an embodiment of the present disclosure.

FIG. 2 shows a schematic circuit structure of a pixel circuit according to an embodiment of the present disclosure. Next, the circuit structure of the pixel circuit will be described in detail in connection with FIGS. 1 and 2. Optionally, as shown in FIG. 2, in the pixel circuit, the input sub-circuit 101 comprises an input transistor M5, the voltage compensation sub-circuit 103 comprises a first compensation transistor M4, a second compensation transistor M2 and a compensation capacitor C1, the driving sub-circuit 102 comprises a driving transistor M3. A gate of the input transistor M5 is connected to the first scan line Scan1, a first electrode of the input transistor M5 is connected to the data line Vdata, and a second electrode of the input transistor M5 is connected to a first terminal of the compensation capacitor C1. A gate of the first compensation transistor M4 is connected to the third scan line EM, a first electrode of the first compensation transistor M4 is connected to a first voltage terminal Vdd, and a second electrode of the first compensation transistor M4 is connected to an input terminal of the driving sub-circuit 102. A gate of the second compensation transistor M2 is connected to the second scan line Gate, a first electrode of the second compensation transistor M2 is connected to the first node N1, and a second electrode of the second compensation transistor M2 is connected to an output terminal of the driving sub-circuit 102, A second terminal of the compensation capacitor C1 is connected to the first node N1. A gate of the driving transistor M3 is connected to the first node N1, and a second electrode of the driving transistor M3 outputs a current for driving light emitting devices OLED to emit light.

Optionally, as shown in FIG. 2, in the pixel circuit, the light emitting control sub-circuit 104 comprises: a plurality of light emitting control transistors M6, M7, M8, gates of the plurality of light emitting control transistors M6, M7, M8 are respectively connected to the plurality of light emitting control signal terminals EM1, EM2, EM3, first electrodes of the plurality of light emitting control transistors M6, M7, M8 are connected to the output terminal of the driving sub-circuit 102, and second electrodes of the plurality of light emitting control transistors M6, M7, M8 are respectively connected to the plurality of light emitting devices OLED1, OLED2, OLED3. As will be appreciated, the three light emitting devices OLED are only exemplary, a person skilled in the art can adjust the number of the light emitting devices according to actual needs.

Optionally, as shown in FIG. 2, in the pixel circuit, the reset sub-circuit 105 comprises: a reset transistor M1, a gate of the reset transistor M1 is connected to the reset signal terminal Reset, a first electrode of the reset transistor M1 is connected to a second voltage terminal Vinit, and a second electrode of the reset transistor M1 is connected to the first node N1.

Optionally, in the pixel circuit shown in FIG. 2, all the transistors are P-type TFTs (Thin Film Transistor), thereby manufacturing process of the module is reduced and production efficiency is improved. However, some or all of the transistors may also adopt N-type TFTs as needed, as long as the level of the related control signal is adjusted accordingly, the specific connection relationship is omitted herein.

Optionally, in the present disclosure, except that the gate of the transistor serves as a control electrode thereof, the first electrode of the transistor may be a source for inputting a signal, and the second electrode of the transistor may serve as a drain for outputting a signal. However, taking into account symmetry of the source and the drain of the transistor, it is entirely possible to interchange the two without affecting the technical solution of the present disclosure.

The specific structure of the pixel circuit according to an embodiment of the present disclosure is described above with reference to FIGS. 1 to 2. The operating states of the pixel circuit according to the above embodiment of the present disclosure in respective phases in a high resolution display mode will be described in detail below with reference to FIGS. 3 to 7. The TFTs in the dashed boxes in FIGS. 4 to 7 represent the TFTs that are turned off, and the arrows represent the current flows in each phase.

Figure 3:
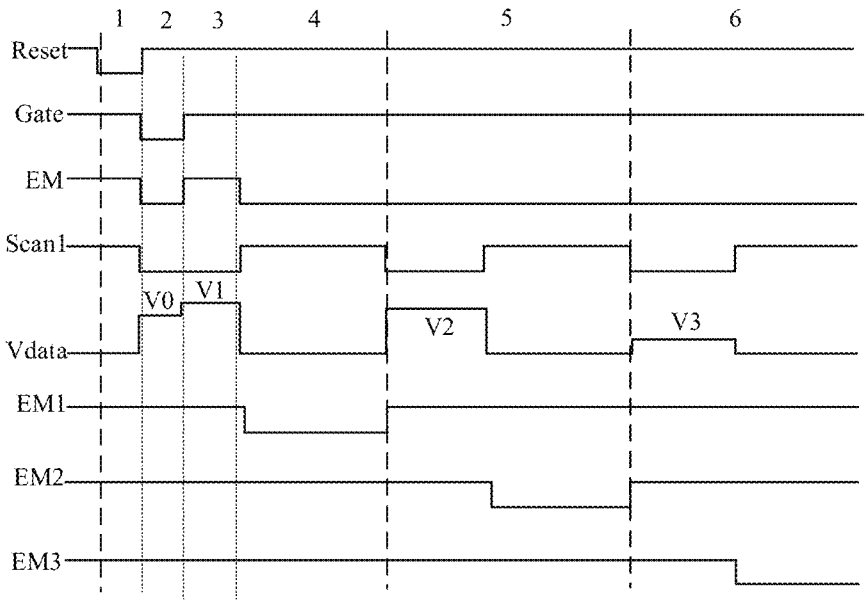
FIG. 3 shows a signal timing applicable to the pixel circuit shown in FIG. 2 in a high resolution display mode according to an embodiment of the present disclosure.
Figure 4:
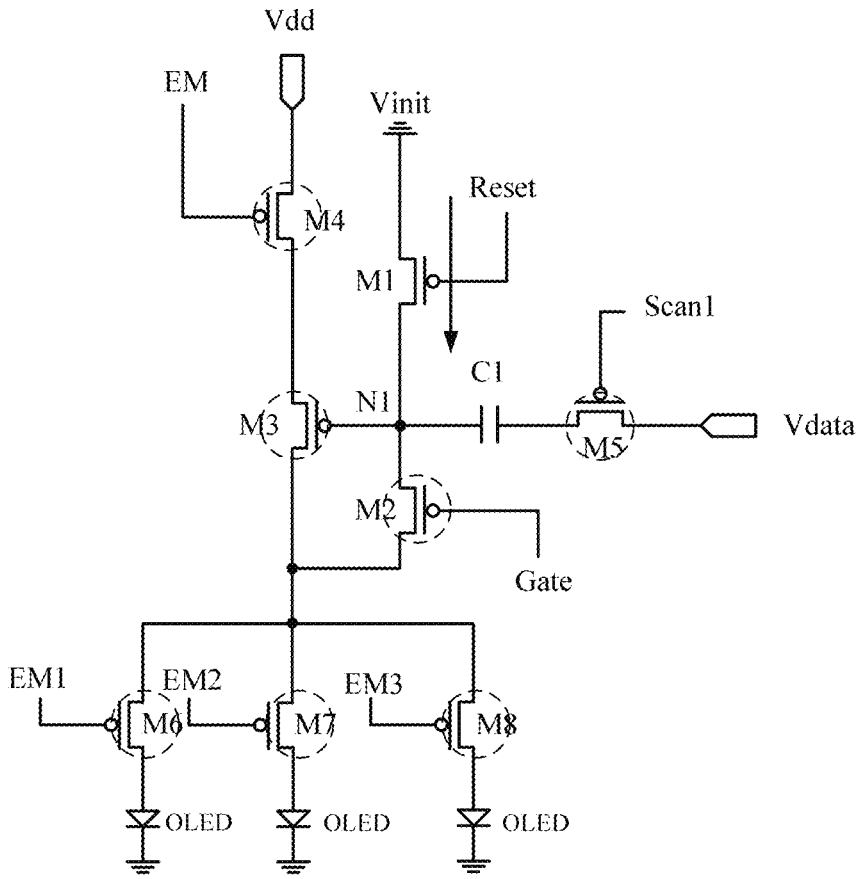
FIGS. 4 to 7 are operating states in respective phases when the signal timing shown in FIG. 3 is applied to the pixel circuit shown in FIG. 2 according to an embodiment of the present disclosure.

FIG. 3 shows a signal timing applicable to the pixel circuit shown in FIG. 2 in a high resolution display mode according to an embodiment of the present disclosure. In the first phase shown in FIG. 3, a low level signal is applied to the reset signal terminal Reset, a high level signal is applied to the first scan signal line Scan1, the second scan signal line Gate and the third scan signal line EM, a high level signal is applied to the first light emitting control signal terminal EM1, the second light emitting control signal terminal EM2 and the third light emitting control signal terminal EM3, and the data signal inputted at the data line Vdata changes to a low level signal. Therefore, as shown in FIG. 4, the reset transistor M1 in the pixel circuit is turned on and other transistors in the pixel circuit are turned off, this process resets the level at the first node N1 to a potential Vinit so as to initialize the potential at the first node, this phase is the reset phase of the pixel circuit.

Figure 5:
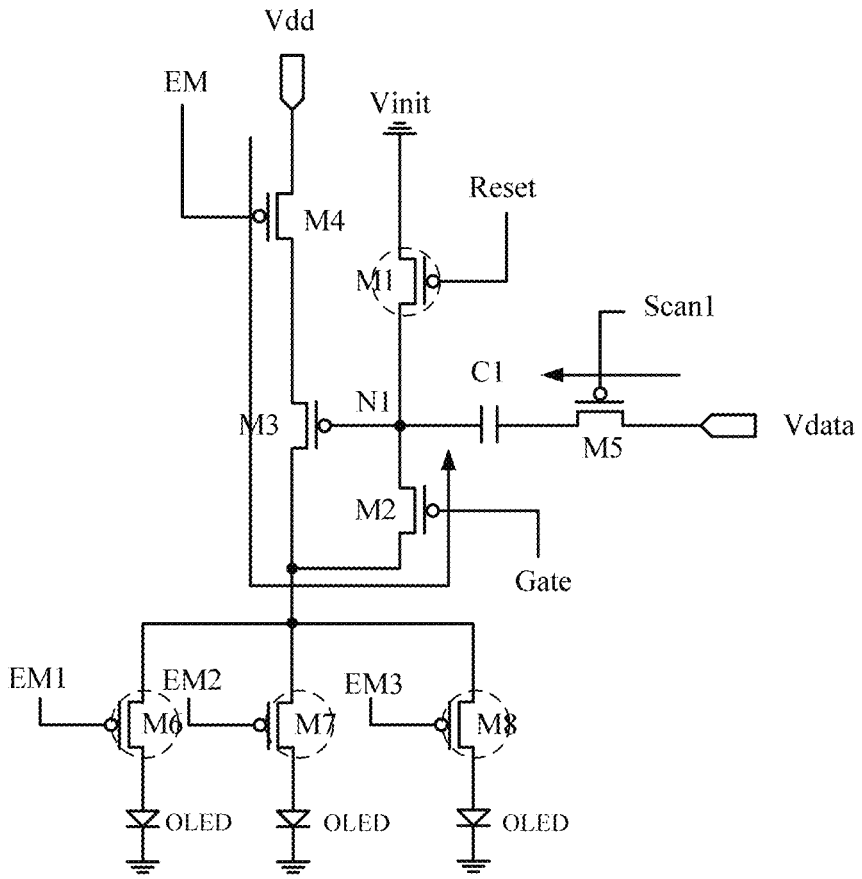

In the second phase shown in FIG. 3, the signal applied to the reset signal terminal Reset changes to a high level signal, the signal applied to the first scan signal line Scan1, the second scan signal line Gate and the third scan signal line EM changes to a low level signal, a high level signal continues to be applied to the first light emitting control signal terminal EM1, the second light emitting control signal terminal EM2 and the third light emitting control signal terminal EM3, and the data signal Vdata inputted at the data line Vdata changes to V0. Thus, as shown in FIG. 5, the reset transistor M1 and the light emitting control transistors M6, M7, M8 in the pixel circuit are turned off, the input transistor M5, the first compensation transistor M4 and the second compensation transistor M2 are turned on because a low level is applied to the gates thereof, and the driving transistor M3 is turned on because the gate thereof is reset to a low level Vinit in the previous phase. The first voltage Vdd signal inputted at the first voltage terminal starts charging the first node N1 through the transistor M4→M3→M2 until the first node N1 is charged to be Vdd−Vth, wherein Vth represents the threshold voltage of the driving transistor M3. The second terminal of the compensation capacitor C1 is connected to the first node N1, thus the potential at the second terminal of the compensation capacitor C1 is charged to Vdd−Vth; the first terminal of the compensation capacitor C1 is connected to the data line Vdata through the input transistor M5, thus the potential at the first terminal of the compensation capacitor C1 is Vdata=V0. This phase is the charging phase of the pixel circuit and also is the first data signal writing phase of the pixel circuit.

Figure 6:
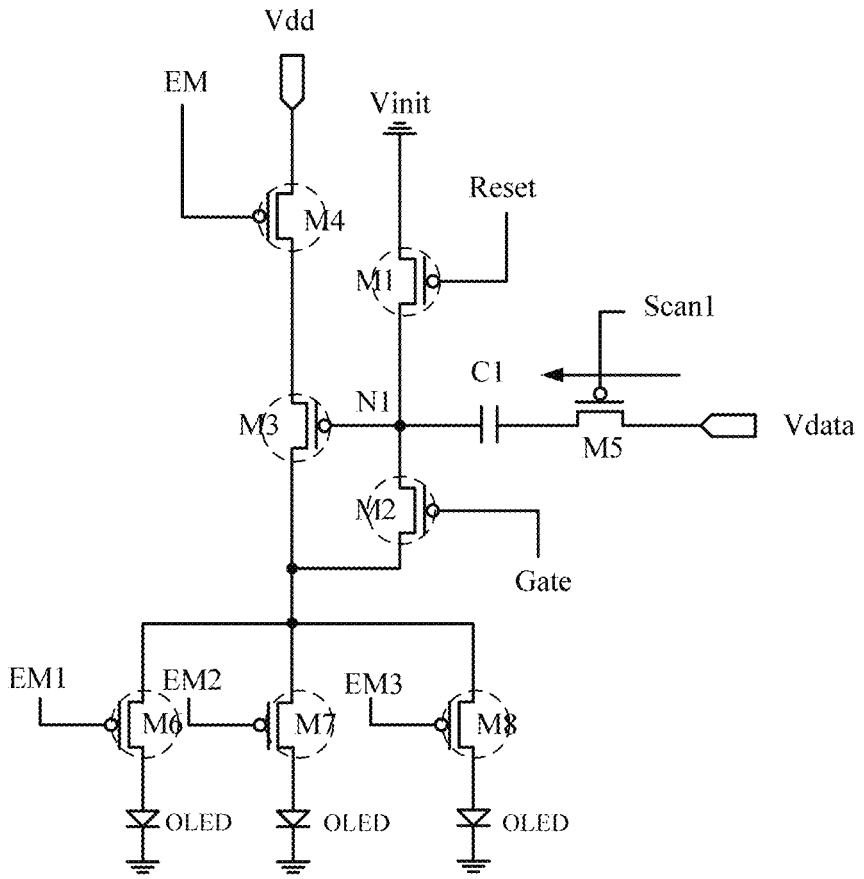

In the third phase shown in FIG. 3, a high level signal continues to be applied to the reset signal terminal Reset, a low level signal continues to be applied to the first scan signal line Scan1, the signal applied to the second scan signal line Gate and the third scan signal line EM changes to a high level signal, a high level signal continues to be applied to the first light emitting control signal terminal EM1, the second light emitting control signal terminal EM2 and the third light emitting control signal terminal EM3, and the data signal Vdata inputted at the data line Vdata changes to V1. Thus, as shown in FIG. 6, the reset transistor M1, the first compensation transistor M4, the second compensation transistor M2 and the light emitting control transistors M6, M7, M8 in the pixel circuit are turned off, and the input transistor M5 remains turned-on because a low level continues to be applied to the gate thereof, the driving transistor M3 is turned off because the gate thereof is charged to Vdd−Vth in the previous phase. The first terminal of the compensation capacitor C1 is connected to the data line Vdata through the input transistor M5, thus the potential at the first terminal of the compensation capacitor C1 is Vdata=V1, The second terminal of the compensation capacitor C1 is connected to the first node N1, due to floating of the first node N1, the potential at the first node N1 changes to Vdd−Vth−V0+V1 based on the bootstrap effect of the capacitor, so as to ensure that a voltage difference Vdd−Vth−V0 across two terminals of the compensation capacitor C1 does not change. This phase is the hopping bootstrap process of the first node N1, that is, the second data signal writing phase of the pixel circuit.

In each of the above phases, no current flows through the OLED due to turn-off of the light emitting control transistors M6, M7, M8, this thereby reducing the power consumption and the lifetime loss of the OLED and ensuring the display quality.

Figure 7:
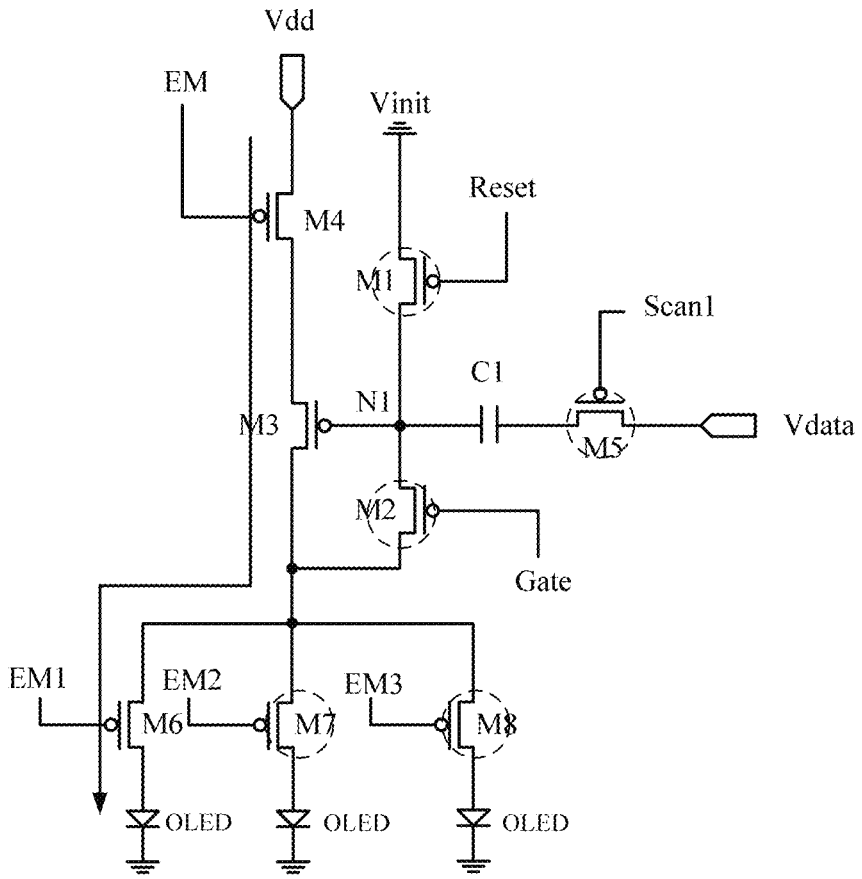

The fourth phase shown in FIG. 3 is a phase in which the pixel circuit drives the light emitting device OLED1 to emit light for displaying. A high level signal continues to be applied to the reset signal terminal Reset and the second scan signal line Gate, the signal applied to the first scan signal line Scan1 changes to a high level signal, the signal applied to the third scan signal line EM changes to a low level signal, the signal applied to the first light emitting control signal terminal EM1 changes to a low level signal, a high level signal continues to be applied to the second light emitting control signal terminal EM2 and the third light emitting control signal terminal EM3, and the data signal Vdata inputted at the data line Vdata changes to a low level signal. Therefore, as shown in FIG. 7, the reset transistor M1, the second compensation transistor M2, the input transistor M5 and the light emitting control transistors M7, M8 in the pixel circuit are turned off, the first compensation transistor M4 and the light emitting control transistor M6 are turned on because a low level is applied to the gates thereof, the driving transistor M3 is turned on because the gate thereof is charged to Vdd−Vth−V0+V1 in the previous phase, a current path passing through the transistors M4→M3→M6 is formed to drive the light emitting device OLED1 to start the light emitting display.

The driving current generated by the driving transistor M3 may be expressed by the following formula (1)

$$I_{OLED1} = K(V_{GS} - Vth)^2 = K[Vdd - (Vdd - Vth - V0 + V1) - Vth]^2 = K(V0 - V1)^2 \quad (1)$$

As can be seen from the above formula (1), the driving current $I_{OLED1}$ is no longer affected by the threshold voltage Vth of the driving transistor, and is only related to the data signal Vdata inputted at the data line Vdata. Therefore, the influence on the driving current $I_{OLED1}$ outputted by the driving transistor caused by drifting of the threshold voltage Vth of the driving transistor due to manufacturing process and long-time operation is eliminated, uniformity of the light emitting display of the respective OLEDs may be ensured, and the display quality may be improved.

In the fifth phase and the sixth phase shown in FIG. 3, since the data signal Vdata inputted at the data line Vdata jumps twice, the potential at the first node N1 also jumps twice, by means of sequentially applying a low level signal to the second light emitting control signal terminal EM2 and the third light emitting control signal terminal EM3, the different driving currents generated by the driving sub-circuit are supplied to the light emitting devices OLED2 and OLED3, so that the light emitting devices OLED2 and OLED3 sequentially emit light to display, and the driving currents $I_{OLED2}$, $I_{OLED3}$, $I_{OLED2}$ of the light emitting devices OLED1, OLED2, OLED3 are different. By combining the light emitting display of OLED1, OLED2, OLED3, richer grayscale information can be displayed, and visual resolution is improved.

The operating states of the pixel circuit according to the above embodiment of the present disclosure in respective phases in a low resolution display mode will be described in detail below with reference to FIG. 8.

Figure 8:
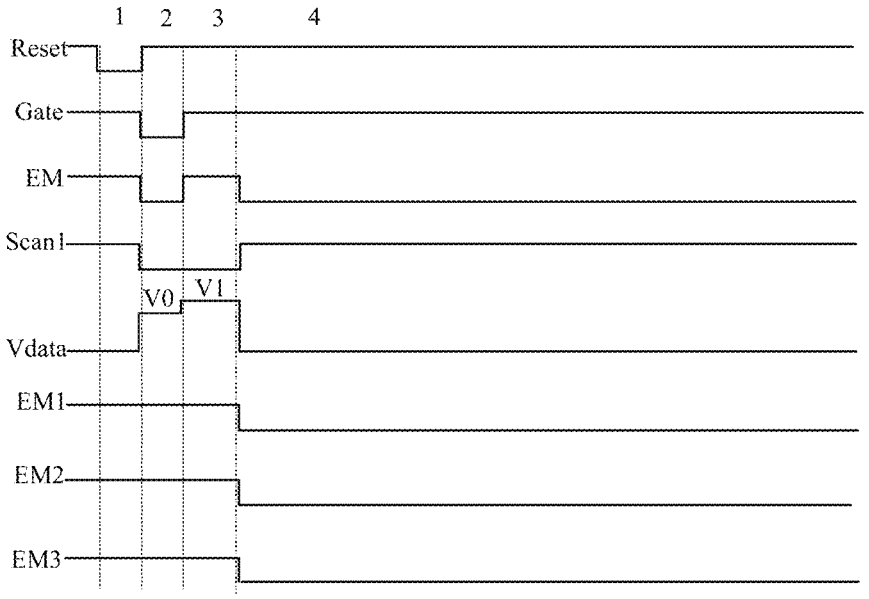
FIG. 8 shows a signal timing applicable to the pixel circuit shown in FIG. 2 in a low resolution display mode according to an embodiment of the present disclosure.

FIG. 8 shows a signal timing applicable to the pixel circuit shown in FIG. 2 in a low resolution display mode according to an embodiment of the present disclosure. At the signal timing shown in FIG. 8, only one color is displayed within one frame of time. In the first phase shown in FIG. 8, a low level signal is applied to the reset signal terminal Reset, a high level signal is applied to the first scan signal line Scan1, the second scan signal line Gate and the third scan signal line EM, a high level signal is applied to the first light emitting control signal terminal EM1, the second light emitting control signal terminal EM2 and the third light emitting control signal terminal EM3, and the data signal inputted at the data line Vdata changes to a low level signal. Thus, reference is made to the operating states of the pixel circuit shown in FIG. 4, the reset transistor M1 in the pixel circuit is turned on and the other transistors in the pixel circuit are turned off. This process resets the level at the first node N1 to the potential Vinit, so that the potential at the first node is initialized, this phase is the reset phase of the pixel circuit.

In the second phase shown in FIG. 8, the signal applied to the reset signal terminal Reset changes to a high level signal, the signal applied to the first scan signal line Scan1, the second scan signal line Gate and the third scan signal line EM changes to a low level signal, a high level signal continues to be applied to the first light emitting control signal terminal EM1, the second light emitting control signal terminal EM2 and the third light emitting control signal terminal EM3, and the data signal Vdata inputted at the data line Vdata changes to V0. Thus, reference is made to the operating states of the pixel circuit shown in FIG. 5, the reset transistor M1 and the light emitting control transistors M6, M7, M8 in the pixel circuit are turned off, the input transistor M5, the first compensation transistor M4 and the second compensation transistor M2 are turned on because a low level is applied to the gates thereof, the driving transistor M3 is turned on because the gate thereof is reset to a low level Vinit in the previous stage. The first voltage Vdd signal inputted at the first voltage terminal starts charging the first node N1 through the transistors M4→M3→M2 until the first node N1 is charged to be Vdd−Vth, wherein Vth represents the threshold voltage of the driving transistor M3. The second terminal of the compensation capacitor C1 is connected to the first node N1, thus the potential at the second terminal of the compensation capacitor C1 is charged to Vdd−Vth; the first terminal of the compensation capacitor C1 is connected to the data line Vdata through the input transistor M5, thus the potential at the first terminal of the compensation capacitor C1 is Vdata=V0. This stage is the charging phase of the pixel circuit, that is, the first data signal writing phase of the pixel circuit.

In the third phase shown in FIG. 8, a high level signal continues to be applied to the reset signal terminal Reset, a low level signal continues to be applied to the first scan signal line Scan1, the signal applied to the second scan signal line Gate and the third scan signal line EM changes a high level signal, a high level signal continues to be applied to the first light emitting control signal terminal EM1, the second light emitting control signal terminal EM2 and the third light emitting control signal terminal EM3, and the data signal Vdata inputted at the data line Vdata jumps to V1. Thus, reference is made to the operating states of the pixel circuit shown in FIG. 6, the reset transistor M1, the first compensation transistor M4, the second compensation transistor M2 and the light emitting control transistors M6, M7 M8 in the pixel circuit are turned off, and the input transistor M5 remains turned-on because a low level continues to be applied to the gate thereof; the driving transistor M3 is turned off because the gate thereof is charged to Vdd−Vth in the previous stage. The first terminal of the compensation capacitor C1 is connected to the data line Vdata through the input transistor M5, thus the potential at the first terminal of the compensation capacitor C1 is Vdata=V1. The second terminal of the compensation capacitor C1 is connected to the first node N1, due to floating of the first node N1, the potential at the first node N1 changes to Vdd−Vth−V0+V1 based on the bootstrap effect of the capacitor, so as to ensure that the voltage difference Vdd−Vth−V0 across two terminals of the compensation capacitor C1 does not change. This phase is the hopping bootstrap process of the first node N1, that is, the second data signal writing stage of the pixel circuit.

In the above respective phases, no current flows through the OLED due to turn-off of the light emitting control transistors M6, M7, M8, thereby reducing power consumption and lifetime loss of the OLED and ensuring the display quality.

The fourth phase shown in FIG. 8 is a phase in which the pixel circuit simultaneously drives the light emitting devices OLED1, OLED2, OLED3 to perform light emitting display. A high level signal continues to be applied to the reset signal terminal Reset and the second scan signal line Gate, the signal applied to the first scan signal line Scan1 changes into a high level signal, the signal applied to the third scan signal line EM changes to a low level signal, the signal applied to the first light emitting control signal terminal EM1, the second light emitting control signal terminal EM2 and the third light emitting control signal terminal EM3 changes to a low level signal, and the data signal Vdata inputted at the data line Vdata changes into a low level signal. Therefore, the reset transistor M1, the second compensation transistor M2 and the input transistor M5 in the pixel circuit are turned off, the first compensation transistor M4 and the light emitting control transistors M6, M7, M8 are turned on because a low level is applied to the gates thereof, and the driving transistor M3 is turned on because the gate thereof is charged to Vdd−Vth−V0+V1 in the previous phase, thus a current path passing through the transistors M4→M3→M6, a current path passing through the transistors M4→M3→M7, and a current path passing through the transistors M4→M3→M8 are formed, the same driving current generated by the driving sub-circuit is provided to the light emitting devices OLED1, OLED2, OLED3, so that the light emitting devices OLED1, OLED2, OLED3 emit light simultaneously to display. In this case, the light emitting devices OLED1, OLED2, OLED3 have the same grayscale information. By combining the light emitting display of the light emitting devices OLED1, OLED2, OLED3, a lower visual resolution can be obtained.

Figure 9:
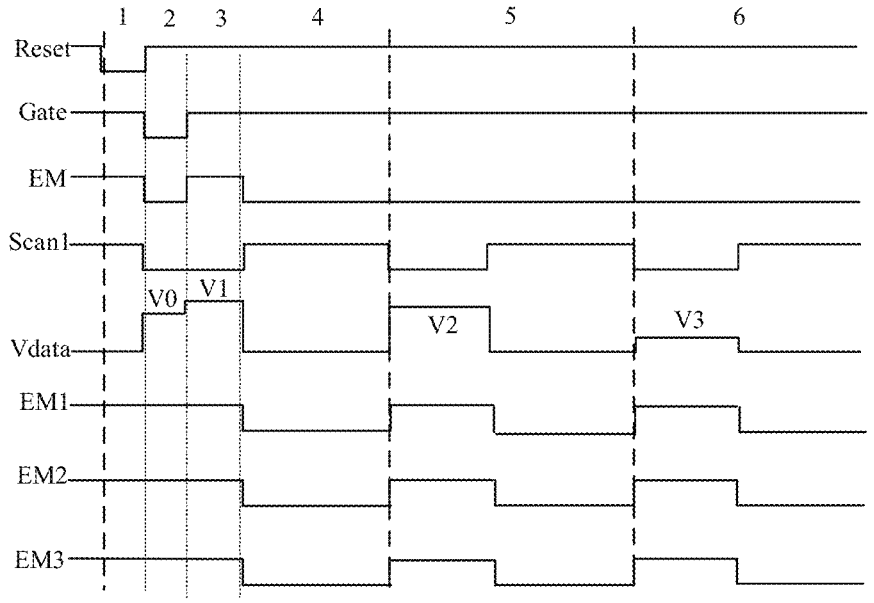
FIG. 9 shows another signal timing applicable to the pixel circuit shown in FIG. 2 in a low resolution display mode according to an embodiment of the present disclosure.

FIG. 9 shows another signal timing applicable to the pixel circuit shown in FIG. 2 in a low resolution display mode according to an embodiment of the present disclosure. At the signal timing shown in FIG. 9, three colors are displayed within one frame of time. The signal timing shown in FIG. 9 differs from the signal timing shown in FIG. 8 in the fifth phase and the sixth phase. In the fifth phase and the sixth phase, since the data signal Vdata inputted at the data line Vdata jumps twice, the potential at the first node N1 also jumps twice, so that the driving current generated by the driving sub-circuit also jumps twice, accordingly, the light emitting devices OLED1, OLED2, and OLED3 can display three colors in one frame of time, a refresh rate of the display is improved. Similar to the signal timing shown in FIG. 8, the light emitting devices OLED1, OLED2, OLED3 have the same grayscale information, and a lower visual resolution can be obtained by combining the light emitting display of the light emitting devices OLED1, OLED2, OLED3.

As can be seen, in the pixel circuit according to the above embodiment, by means of writing the hopping data signal on the data line into the voltage compensation sub-circuit, the voltage compensation sub-circuit is made to generate a compensation voltage at the first node, threshold voltage compensation can be therefore performed on the driving transistor, which eliminates the influence on light emitting display of the light emitting devices caused by drifting of the threshold voltage of the driving transistor in the pixel circuit. In addition, in the pixel circuit according to the above embodiment, the resolution of the pixel area may be adjusted by controlling the data signal on the data line and controlling the effective level applied to the plurality of light emitting control signal terminals according to adjustment requirement of the display resolution, and luminescence of the plurality of light emitting devices may be combined to achieve different visual resolutions.

Optionally, in the pixel circuit of the above embodiment, red, green and blue may be displayed by using the light emitting devices OLED1, OLED2, OLED3 respectively, so as to constitute three primary colors RGB of one pixel. However, the principle of the present disclosure is not limited thereto, the three light emitting devices OLED are only exemplary, in fact, the number of the light emitting devices may be adjusted according to actual needs, for example, four light emitting devices may be used to respectively display red, green, blue and yellow, or respectively display red, green, blue and white, resulting in richer display color and higher picture quality.

Figure 10:
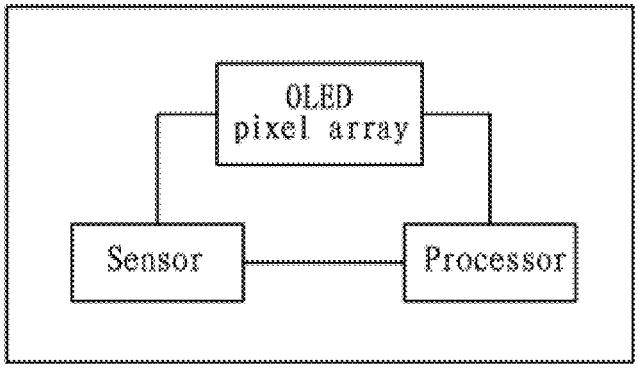
FIG. 10 shows a block diagram of a display panel according to an embodiment of the present disclosure.

According to an aspect of the present disclosure, a display panel is further provided. As shown in FIG. 10, the display panel comprises an OLED pixel array, wherein each OLED pixel may be constituted by the above pixel circuit; at least one sensor configured to detect eye movement of a user viewing an interface of the display panel and generate an eye movement detection signal; and a processor configured to determine an area on the interface concerned by the user according to the eye movement detection signal, and change the data signal on the data line in the pixel circuit corresponding to the area, sequentially apply an effective level to the plurality of light emitting control signal terminals, thereby increase a resolution in the area.

Optionally, the pixel array of the display panel may be zoned, area of the zonation may be determined according to specific viewing needs. With eye tracking technology, a position of an area on the screen which human eyes are interested in is determined, and the area of interest is displayed at a higher resolution, while other areas of non-interest are displayed at a lower resolution. Specifically, eye movement of the user may be detected by a sensor, and the specific area viewed by the user may be determined by the sensor, so as to achieve resolution differentiation of display areas. As the position where human eyes view changes, it is possible to switch among resolutions of areas at different positions, the effect of adjustable resolution is truly achieved. Thereby, resolutions of the respective display areas can be dynamically adjusted in real time, and the display power consumption is reduced.

Figure 11:
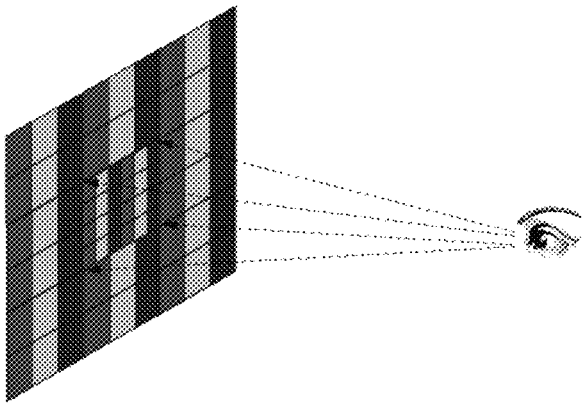
FIG. 11 illustrates the principle of adopting different resolutions for the respective areas on the display interface according to visual attention of the user.

For example, as shown in FIG. 11, it is possible to adopt the high resolution display mode in the area of interest to the user and adopt the low resolution display mode in other areas, thereby the display power consumption can be reduced.

Optionally, displaying may be performed in a manner of combining pixels according to actual needs. For example, in order to avoid distortion, pixels may be combined in a square display mode to display the picture pixels. For example, displaying is performed in a manner of binding one, four or nine physical pixels, wherein when one physical pixel corresponds to one picture pixel to be displayed, it represents the high resolution display mode, and when nine physical pixels correspond to one picture pixel, it represents the low resolution display mode.

According to another embodiment of the present disclosure, there is further provided a display device comprising the display panel described above, the display device may be an AMOLED display, a television set, a digital photo frame, a mobile phone, a tablet computer and any products or components having a display function.

Figure 12:
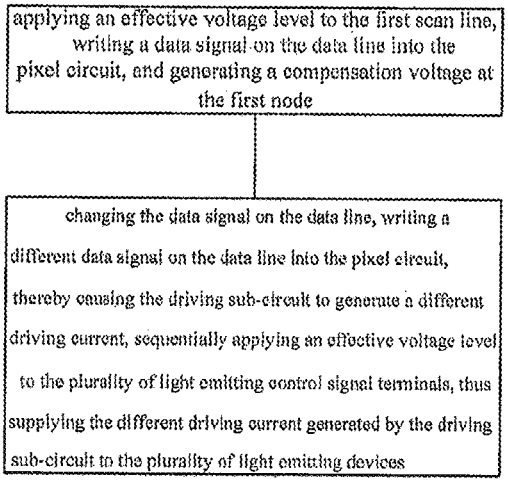
FIG. 12 is a schematic flowchart of a driving method applicable to the pixel circuit according to an embodiment of the present disclosure.

According to an embodiment of the present disclosure, there is further provided a method for driving the pixel circuit described above, as shown in FIG. 12, said method comprises: applying an effective level to the first scan line, writing a hopping data signal on the data line into the pixel circuit, and generating a compensation voltage at the first node.

Optionally, the method further comprises: applying an effective level to the first scan line, the second scan line and the third scan line, enabling the input sub-circuit and the voltage compensation sub-circuit, writing the hopping data signal on the data line into the pixel circuit, and generating a compensation voltage at the first node.

Optionally, the method further comprises: in the case of displaying at a first resolution, changing the data signal on the data line, writing different data signals on the data line into the pixel circuit, thereby causing the driving sub-circuit to generate different driving currents, sequentially applying effective levels to the plurality of light emitting control signal terminals, thus supplying different driving currents generated by the driving sub-circuit to the plurality of light emitting devices; in the case of displaying at a second resolution, simultaneously applying an effective level to the plurality of light emitting control signal terminals, so as to provide the driving current generated by the driving sub-circuit to the plurality of light emitting devices, wherein the first resolution being higher than the second resolution.

Optionally, the method further comprises: before applying an effective level to the first scan line, applying an effective level to the reset signal terminal, enabling the reset sub-circuit, and resetting the first node.

To sum up, in the above embodiment of the present disclosure, by means of writing the hopping data signal on the data line into the voltage compensation sub-circuit, the voltage compensation sub-circuit is made to generate a compensation voltage at the first node, threshold voltage compensation can be therefore performed on the driving transistor, which eliminates the influence on light emitting display of the light emitting devices caused by drifting of the threshold voltage of the driving transistor in the pixel circuit. In addition, the resolution of the pixel area may be adjusted by controlling the data signal on the data line and controlling the effective level applied to the plurality of light emitting control signal terminals according to adjustment requirement of the display resolution, and luminescence of the plurality of light emitting devices may be combined to achieve different visual resolutions. In the pixel circuit and the driving method thereof and the display panel according to the present disclosure, threshold voltage compensation performed on the driving transistor of the pixel circuit and smart displaying are combined, and resolution of the display panel can be adjusted in real time with respect to that users have different attentions on the picture displayed by the display panel.

The above described merely are specific implementations of the present disclosure, but the protection scope of the present disclosure is not limited thereto, modification or replacements easily conceivable for a person skilled in the art within the technical range revealed by the present disclosure all fall into the protection scope of the present disclosure. Therefore, the protection scope of the present disclosure is based on the protection scope of the claims.

What is claimed is:

1. A pixel circuit, comprising:

an input sub-circuit, a driving sub-circuit and a voltage compensation sub-circuit, wherein the input sub-circuit is connected to a data line and a first scan line, and configured to input a data signal inputted at the data line to the voltage compensation sub-circuit under control of the first scan line;

the voltage compensation sub-circuit is connected to a first node, a second scan line and a third scan line, and configured to generate a compensation voltage at the first node under control of the second scan line and the third scan line;

the driving sub-circuit is connected to the voltage compensating sub-circuit, and configured to generate a current for driving a light emitting device to emit light, using the compensation voltage generated by the voltage compensating sub-circuit at the first node, wherein the input sub-circuit comprises an input transistor, the voltage compensation sub-circuit comprises a first compensation transistor, a second compensation transistor and a compensation capacitor, the driving sub-circuit comprises a driving transistor, a gate of the input transistor is connected to the first scan line, a first electrode of the input transistor is connected to the data line, and a second electrode of the input transistor is connected to a first terminal of the compensation capacitor;

a gate of the first compensation transistor is connected to the third scan line, a first electrode of the first compensation transistor is connected to a first voltage terminal, and a second electrode of the first compensation transistor is connected to an input terminal of the driving sub-circuit;

a gate of the second compensation transistor is connected to the second scan line, a first electrode of the second compensation transistor is connected to the first node, and a second electrode of the second compensation transistor is connected to an output terminal of the driving sub-circuit;

a second terminal of the compensation capacitor is connected to the first node;

a gate of the driving transistor is connected to the first node, and a second electrode of the driving transistor outputs a current for driving the light emitting device to emit light.

2. The pixel circuit according to claim 1, wherein the pixel circuit further comprises:

a light emitting control sub-circuit connected to a plurality of light emitting devices, a plurality of light emitting control signal terminals and the driving sub-circuit, said light emitting control sub-circuit being configured to provide the driving current generated by the driving sub-circuit to the plurality of light emitting devices, under control of light emitting control signals inputted at the plurality of light emitting control signal terminals.

3. The pixel circuit according to claim 2, wherein the light emitting control sub-circuit comprises:

a plurality of light emitting control transistors, gates of the plurality of light emitting control transistors are respectively connected to the plurality of light emitting control signal terminals, first electrodes of the plurality of light emitting control transistors are connected to the output terminal of the driving sub-circuit, and second electrodes of the plurality of light emitting control transistors are respectively connected to the plurality of light emitting devices.

4. A display panel, comprising:

a plurality of pixel circuits according to claim 2 arranged in an array.

5. The display panel according to claim 4, further comprising:

at least one sensor configured to detect eye movement of a user viewing an interface of the display panel and generate an eye movement detection signal; and a processor configured to determine an area on the interface concerned by the user according to the eye movement detection signal, and change the data signal on the data line in the pixel circuit corresponding to the area, sequentially apply an effective level to the plurality of light emitting control signal terminals, so as to increase a resolution in the area.

6. The pixel circuit according to claim 2, wherein the pixel circuit further comprises:

a reset sub-circuit connected to a reset signal terminal and the first node, and configured to reset the first node under control of a reset signal inputted at the reset signal terminal.

7. The pixel circuit according to claim 1, wherein the pixel circuit further comprises:

a reset sub-circuit connected to a reset signal terminal and the first node, and configured to reset the first node under control of a reset signal inputted at the reset signal terminal.

8. The pixel circuit according to claim 7, wherein the reset sub-circuit comprises:

a reset transistor, a gate of the reset transistor being connected to the reset signal terminal, a first electrode of the reset transistor being connected to a second voltage terminal, and a second electrode of the reset transistor being connected to the first node.

9. A method of driving the pixel circuit according to claim 1, comprising:

applying an effective level to the first scan line, and writing a data signal hopped on the data line into the pixel circuit.

10. The method according to claim 9, wherein the method further comprises:

applying an effective level to the second scan line and the third scan line, enabling the input sub-circuit and the voltage compensation sub-circuit, and generating a compensation voltage at the first node.

11. The method according to claim 10, wherein the pixel circuit comprises a light emitting control sub-circuit connected to a plurality of light emitting devices, a plurality of light emitting control signal terminals and the driving sub-circuit;

the method further comprises:

in the case of displaying at a first resolution, changing the data signal on the data line, writing a different data signal on the data line into the pixel circuit, thereby causing the driving sub-circuit to generate a different driving current, sequentially applying an effective level to the plurality of light emitting control signal terminals, thus supplying the different driving current generated by the driving sub-circuit to the plurality of light emitting devices;

in the case of displaying at a second resolution, simultaneously applying an effective level to the plurality of light emitting control signal terminals, so as to provide the driving current generated by the driving sub-circuit to the plurality of light emitting devices, wherein the first resolution being higher than the second resolution.

12. The method according to claim 10, wherein the pixel circuit further comprises a reset sub-circuit connected to the reset signal terminal and the first node, the method further comprises:

before applying an effective level to the first scan line, applying an effective level to the reset signal terminal, enabling the reset sub-circuit, and resetting the first node.

13. The method according to claim 9, wherein the pixel circuit comprises a light emitting control sub-circuit connected to a plurality of light emitting devices, a plurality of light emitting control signal terminals and the driving sub-circuit;

the method further comprises:

in the case of displaying at a first resolution, changing the data signal on the data line, writing a different data signal on the data line into the pixel circuit, thereby causing the driving sub-circuit to generate a different driving current, sequentially applying an effective level to the plurality of light emitting control signal terminals, thus supplying the different driving current generated by the driving sub-circuit to the plurality of light emitting devices;

in the case of displaying at a second resolution, simultaneously applying an effective level to the plurality of light emitting control signal terminals, so as to provide the driving current generated by the driving sub-circuit to the plurality of light emitting devices, wherein the first resolution being higher than the second resolution.

14. The method according to claim 13, wherein the pixel circuit further comprises a reset sub-circuit connected to the reset signal terminal and the first node, the method further comprises:

before applying an effective level to the first scan line, applying an effective level to the reset signal terminal, enabling the reset sub-circuit, and resetting the first node.

15. The method according to claim 9, wherein the pixel circuit further comprises a reset sub-circuit connected to the reset signal terminal and the first node, the method further comprises:

before applying an effective level to the first scan line, applying an effective level to the reset signal terminal, enabling the reset sub-circuit, and resetting the first node.

* * * * *